US010905196B2

(12) United States Patent
Steere, Jr. et al.

(10) Patent No.: US 10,905,196 B2
(45) Date of Patent: Feb. 2, 2021

(54) COMFORT IN MOTION FOOTWEAR

(71) Applicant: TBL Licensing LLC, Stratham, NH (US)

(72) Inventors: John R. Steere, Jr., Stratham, NH (US); Stephanie Howard, Boston, MA (US); Alex Dardinski, Newburyport, MA (US); Michael P. Kirk, Beverly, MA (US); Emily Alati, Portsmouth, NH (US); Jacquelyn Burlage, Dover, NH (US)

(73) Assignee: TBL Licensing LLC, Stratham, NH (US)

( * ) Notice: Subject to any disclaimer, the term of this patent is extended or adjusted under 35 U.S.C. 154(b) by 338 days.

(21) Appl. No.: 16/117,830

(22) Filed: Aug. 30, 2018

(65) Prior Publication Data

US 2020/0068991 A1 Mar. 5, 2020

(51) Int. Cl.

| | |
|---|---|
| ***A43B 17/00*** | (2006.01) |
| ***A43B 17/02*** | (2006.01) |
| ***A43B 7/08*** | (2006.01) |
| ***A43B 13/18*** | (2006.01) |
| ***A43B 17/14*** | (2006.01) |
| ***A43B 17/18*** | (2006.01) |

(Continued)

(52) U.S. Cl.

CPC ..... *A43B 17/02* (2013.01); *A43B 3/24* (2013.01); *A43B 3/248* (2013.01); *A43B 7/08* (2013.01); *A43B 13/184* (2013.01); *A43B 17/003* (2013.01); *A43B 17/006* (2013.01); *A43B 17/14* (2013.01); *A43B 17/18* (2013.01); *A43B 23/0245* (2013.01)

(58) Field of Classification Search

CPC ..... A43B 3/24; A43B 3/248; A43B 7/085; A43B 17/00; A43B 17/006; A43B 23/088

USPC ..... 36/15, 44, 30 R

See application file for complete search history.

(56) References Cited

U.S. PATENT DOCUMENTS 4,685,224 A * 8/1987 Anger ..... A43B 17/08 36/43

4,879,821 A * 11/1989 Graham ..... A43B 7/142 36/44

(Continued)

FOREIGN PATENT DOCUMENTS

EP 1716772 A1 11/2006

OTHER PUBLICATIONS

Extended European Search Report for EP19194476.8 dated Jan. 29, 2020.

*Primary Examiner* — Marie D Bays

(74) *Attorney, Agent, or Firm* — Lerner, David, Littenberg, Krumholz & Mentlik, LLP

(57) ABSTRACT

A holistically improved shoe that incorporates beneficial aspects relating to a variety of interconnected elements, including comfort, sustainability, washability, ease of manufacturing, style, freedom and natural movement of the foot, as well as the sensory experience of a user. The shoe contains a removable insert that is configured to be removed and washed in between uses or as needed, such that a sock or other liner is unnecessary. The shoe further includes a footbed and an outsole that contain matching tread patterns. The matching tread patterns of the present technology allow the footbed and the outsole to move in concert by splaying during a stride in order to better absorb shock by mimicking the natural movements of the foot.

17 Claims, 11 Drawing Sheets

(51) Int. Cl.
*A43B 23/02* (2006.01)
*A43B 3/24* (2006.01)

(56) References Cited

U.S. PATENT DOCUMENTS 6,023,857 A * 2/2000 Vizy ..... A43B 13/36 36/28
6,092,311 A * 7/2000 MacNamara ..... A43B 1/0036 36/100
6,199,304 B1 * 3/2001 Ludemann ..... A43B 17/02 36/3 R
7,900,379 B2 * 3/2011 Lafortune ..... A43B 13/125 36/100
8,914,998 B2 * 12/2014 Gheorghian ..... A43B 13/181 36/103
2001/0001903 A1 * 5/2001 Di Girolamo ..... A43B 7/125 36/3 R
2004/0255486 A1 * 12/2004 Pawlus ..... A43B 3/10 36/10
2005/0066544 A1 * 3/2005 Beak ..... A41B 11/008 36/43
2005/0188562 A1 * 9/2005 Clarke ..... A43B 23/0245 36/15
2006/0143948 A1 * 7/2006 Beak ..... A43B 17/18 36/43
2007/0186446 A1 * 8/2007 Lafortune ..... A43B 13/40 36/43
2007/0271826 A1 * 11/2007 Mirza ..... A43B 1/0036 36/132
2009/0277042 A1 11/2009 Glover
2010/0236100 A1 * 9/2010 Ho ..... A43B 3/24 36/100
2011/0041365 A1 * 2/2011 Ludemann ..... A43B 7/144 36/3 R
2011/0302805 A1 * 12/2011 Vito ..... A43B 7/1465 36/44
2012/0090198 A1 * 4/2012 Stratten ..... A43B 1/0045 36/44
2012/0192452 A1 * 8/2012 Lewis ..... A43B 13/38 36/44
2013/0180023 A1 * 7/2013 Gross ..... A43B 17/02 2/22
2015/0289590 A1 10/2015 Jones et al.
2017/0127760 A1 5/2017 Arquilla
2019/0159548 A1 * 5/2019 Strelli ..... B29D 35/122

* cited by examiner

COMFORT IN MOTION FOOTWEAR

BACKGROUND OF THE INVENTION

The present technology relates, in general, to holistically improved footwear that incorporates beneficial aspects relating to a variety of interconnected elements. The interconnected elements are configured to provide benefits including comfort, sustainability, washability, ease of manufacturing, style, freedom and natural movement of the foot, as well as an enhanced sensory experience for the wearer.

Footwear has been conventionally designed, in many instances, to address only a single aspect or to provide only a single benefit. For example, a shoe designed for its comfort and ergonomic benefits may be lacking in aesthetics and style, and vice versa. A shoe designed to be washable may be produced from synthetic materials that do not promote environmental sustainability.

It is has been noted in the healthcare and wellness fields that the health and wellbeing of an individual can involve many interconnected factors and therefore, a holistic approach is necessary to generally improve quality of life. The present technology applies this principal to footwear and provides for a shoe that is designed to be an integral and beneficial part of daily life. Each element of the present technology is designed to work alongside other elements to collectively and cohesively provide multiple improvements via a synergistic effect.

BRIEF SUMMARY OF THE INVENTION

Aspects of the present technology provide a shoe designed with interconnected elements that cooperate to allow for natural movement of the foot while simultaneously providing an aesthetically pleasing and stylish piece of footwear produced from sustainable materials. The present technology may further allow for a shoe that is designed to be worn without a sock, in order to provide greater convenience, better hygiene, more efficient thermoregulation, and a generally improved sensory experience for a wearer.

Aspects of the present technology provide a shoe, comprising: an upper; an insole having a substantially planar top surface and a bottom surface opposite the top surface; a space between the upper and the insole defining a cavity adapted to receive a wearer's foot; an outsole having a bottom surface configured to contact the ground and a top surface opposite the bottom surface, the top surface of the outsole being permanently secured to the bottom surface of the insole and to a perimeter of the upper, and the bottom surface of the outsole having a tread pattern comprising a series of lateral ridges and troughs; and a removable insert having a bottom surface configured to contact the substantially planar top surface of the insole and a top surface opposite the bottom surface and configured to contact a wearer's foot during wear, the bottom surface of the removable insert having a tread pattern that corresponds to the tread pattern of the outsole; wherein the removable insert is received within the cavity defined by the upper and the substantially planar top surface of the insole.

The removable insert may further comprise a footbed cover having a top surface and a bottom surface, a footbed having a top surface and a bottom surface, and a heel cup; and the bottom surface of the footbed comprises the tread pattern of the removable insert.

In some aspects, the bottom surface of the footbed cover is permanently affixed to the top surface of the footbed, and the heel cup is permanently attached to both the footbed cover and the footbed in a heel region thereof.

The footbed may comprise a tactile pattern on the top surface thereof, the tactile pattern having contours in an inverse of the tread pattern on the bottom surface of the footbed. In some embodiments, the footbed comprises a bio-based foam.

In some aspects, the top surface of the footbed cover reflects the contours of the tactile pattern of the footbed. In some embodiments, the footbed cover comprises a wool blend.

In an embodiment, the heel cup may include a fastening tab and the upper may include a fastening dock configured to receive and engage the fastening tab to removably secure the removable insert to the upper. In some instances, the fastening tab of the heel cup and the fastening dock form corresponding parts of a fastening mechanism selected from the group consisting of a tab and slot, hook and loop fasteners, a snap connection, a button and slot, and complementary ferromagnetic materials.

In a preferred embodiment, the tread pattern of the outsole and the corresponding tread pattern of the removable insert are configured to allow the removable insert and the outsole to move in a same manner during wear by a wearer. For example, the removable insert and the outsole may both be configured to splay in response to application of pressure during a stride in accordance with the respective tread patterns.

In one embodiment, the outsole further includes a grid pattern of both longitudinal and lateral sipes. In certain embodiments, the tread pattern of the outsole is formed with a first material, the outsole further includes one or more strike pods formed along the bottom surface, and the strike pods are formed of a second material different from the first material.

In some embodiments, the upper includes a pattern of perforations in a forefoot region thereof, the perforations providing ventilation and flexibility, and the perforations being configured to expand when force is applied to the interior of the upper. In some instances, the perforations are one or more of circles, ovals, slits, triangles or diamonds. In some cases, the pattern includes perforations of a larger dimension in a center region of the pattern and perforations of a smaller dimension along a perimeter region of the pattern.

In one embodiment, a forefoot region of the upper is at least partly secured to the top surface of the insole by elastic straps disposed with the cavity of the shoe.

DETAILED DESCRIPTION

Figure 1A:
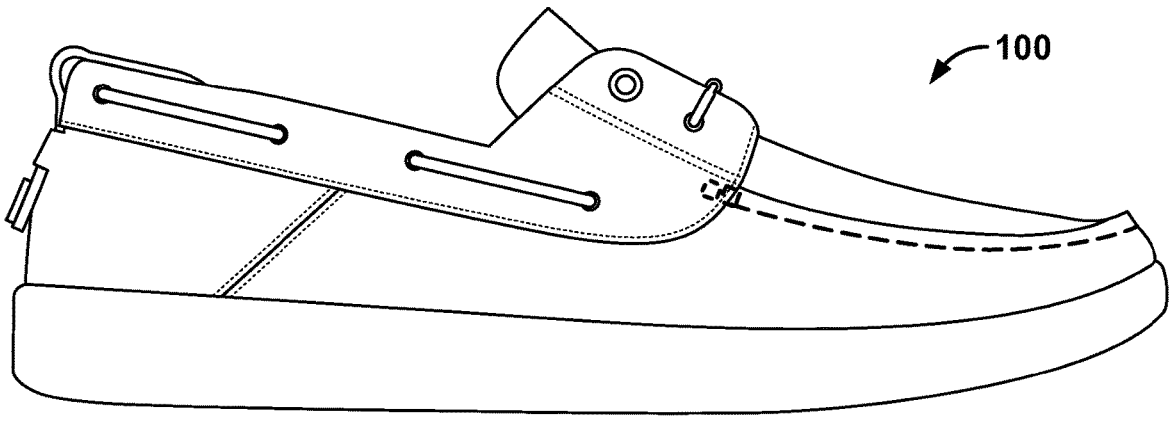
FIG. 1A is a side view of a shoe according to aspects of the present technology.
Figure 1B:
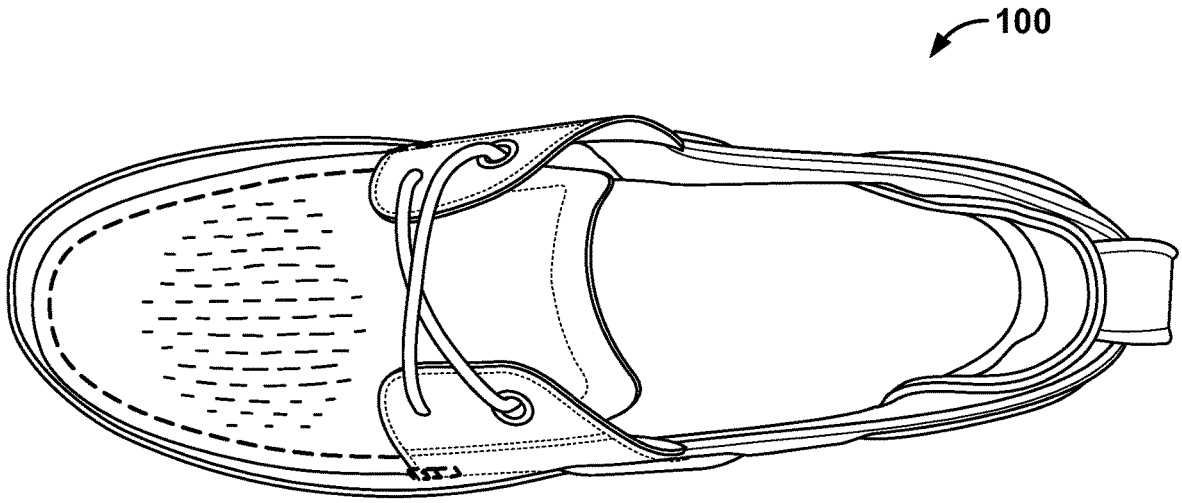
FIG. 1B is a top down view of a shoe according to aspects of the present technology.

As shown in FIGS. 1A-B, aspects of the technology provide a shoe 100 or other article of footwear designed with complimentary elements that coordinate to result in enhanced wellbeing of the wearer. For instance, the shoe 100 is desirably constructed using as few separate components as possible in order to allow for ease of production, lessen waste of materials, and provide a clean, stylish look. The components of the shoe are produced from high-quality, natural materials in order to provide for durability, environmental sustainability, breathability, washability, and comfort. The shoe employs components whose complementary mechanical operation allows for natural movement and splaying of the foot when walking.

Figure 2A:
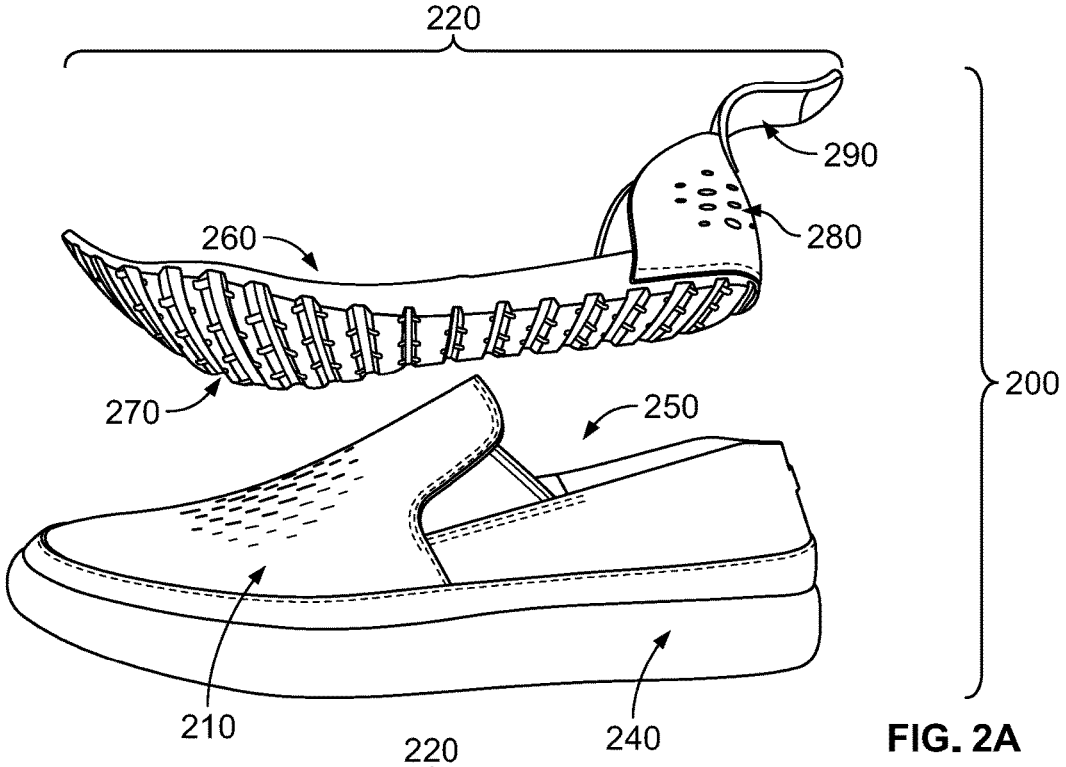
FIG. 2A is a side view of separated components of the shoe according to aspects of the present technology.
Figure 2B:
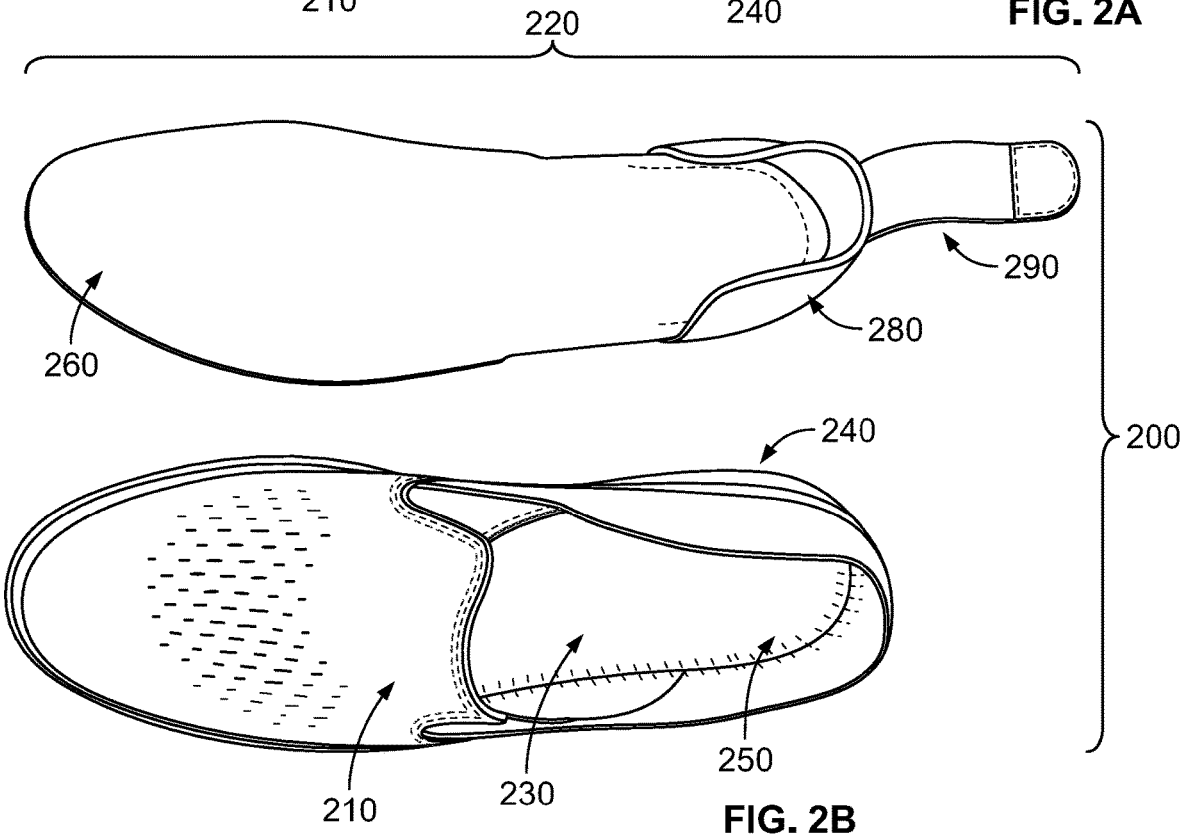
FIG. 2B is a top down view of separated components of the shoe, according to aspects of the present technology.

FIGS. 2A-B depict components of an exemplary shoe 200 of the present technology. The components include an upper 210, a removable insert 220, an insole 230, and an outsole 240. The outsole 240 of the shoe 200 is designed to contact the ground on a bottom surface thereof. The bottom surface of the outsole 240 comprises a tread pattern, of which features are described in detail below. A top region of the outsole 240 is permanently affixed to the upper 210 and insole 230. For example, a bottom surface of the insole 230 is secured to a top surface of the outsole 240. A bottom perimeter of the upper 210 is secured to an edge of the top region of the outsole 240. The insole 230 and upper 210 form a cavity 250 adapted to receive the removable insert 220 and the wearer's foot.

As shown in an embodiment depicted in FIGS. 2A-B, the removable insert 220 comprises three integral components: a footbed cover 260, a footbed 270, and a heel cup 280. The removable insert 220 is configured to fit within the cavity 250 so that a bottom surface of the footbed 270 contacts a top surface of the insole 230. A top surface of the footbed 270 opposite the bottom surface is permanently secured to the footbed cover 260. The heel cup 280 extends generally vertically from the footbed 270 and footbed cover 260. The heel cup 280 is arranged to fit snugly against a heel portion of the upper 210. The bottom surface of the footbed 270 comprises a tread pattern that corresponds to the tread pattern of the outsole 240. This allows complementary mechanical operation of the two components.

In an embodiment, the removable insert 220 is designed to be removed from the shoe 200. Thus, the removable insert 220 can be washed, repaired, and/or replaced. The removable insert 220 may also include a fastening mechanism 290 that extends from the heel cup 280 in order to engage with the upper 210 so that the removable insert 220 is removably secured within the cavity 250 of the shoe 200. This configuration prevents the removable insert 220 from sliding or coming out of the cavity of the shoe during use, or even when the shoe is not being worn. These components are discussed in detail below.

In an embodiment, the insole 230 is permanently affixed to the outsole 240 on one (bottom) surface and to the upper 210 along the perimeter of the opposing (top) surface, meaning that it cannot be removed without destroying the shoe and rendering it unwearable. The top surface is continuous and substantially planar, for instance without any grooves, recesses, slits, holes, divots, ridges, troughs, or the like along the continuous surface. Thus, the top surface of the insole 230 does not include the tread pattern found on the bottom surfaces of the outsole 240 and footbed 270. The top surface of the insole 230 is configured to receive the bottom surface of the removable insert 220 thereon, while enabling the bottom surface of the removable insert 220 to react as the wearer steps or otherwise moves.

Figure 8A:
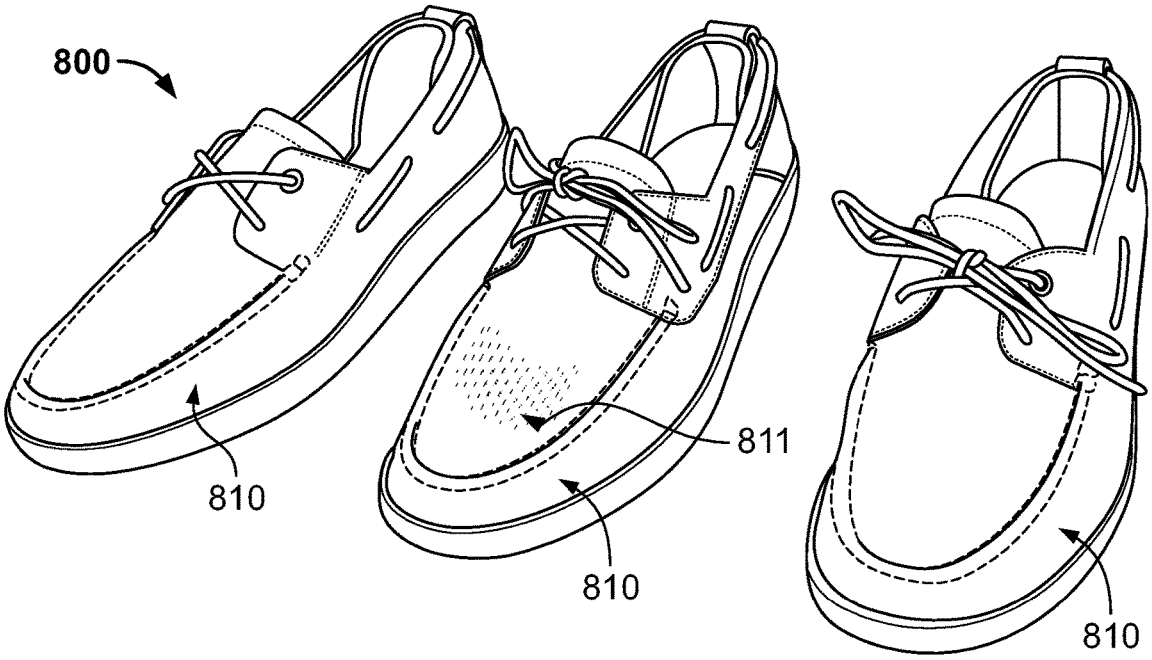
FIG. 8A is a depiction of exemplary uppers in accordance with aspects of the technology.
Figure 8B:
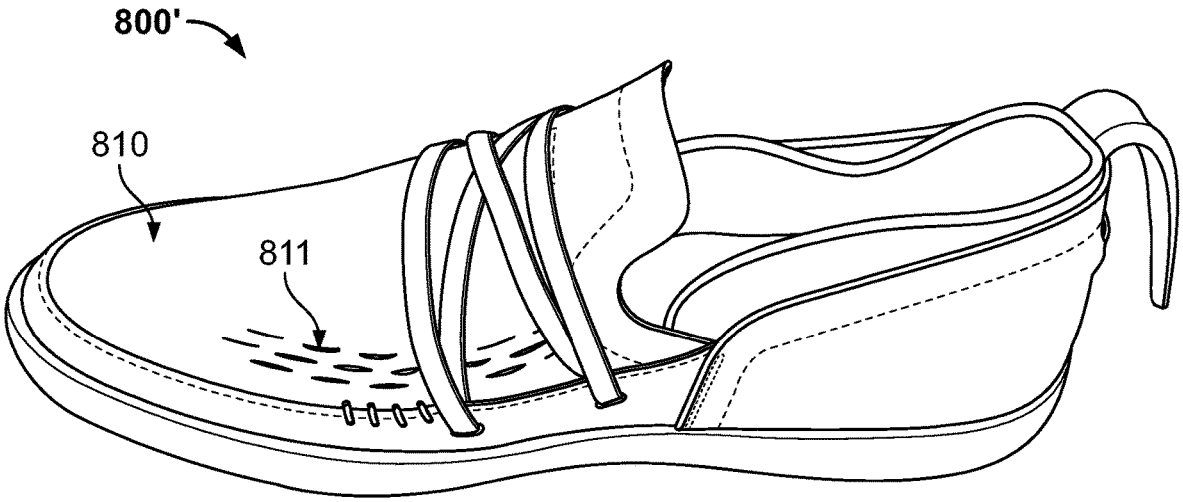
FIG. 8B is a depiction of an exemplary upper in accordance with aspects of the technology.

The upper 210 is constructed from as few pieces of material as possible. As illustrated in FIGS. 8A-B and discussed further below, the upper 210 may have a pattern that includes strategically place knife-cuts, slits, holes, or other perforations that allow for flexibility and breathability of the shoe.

Outsole

Figure 3A:
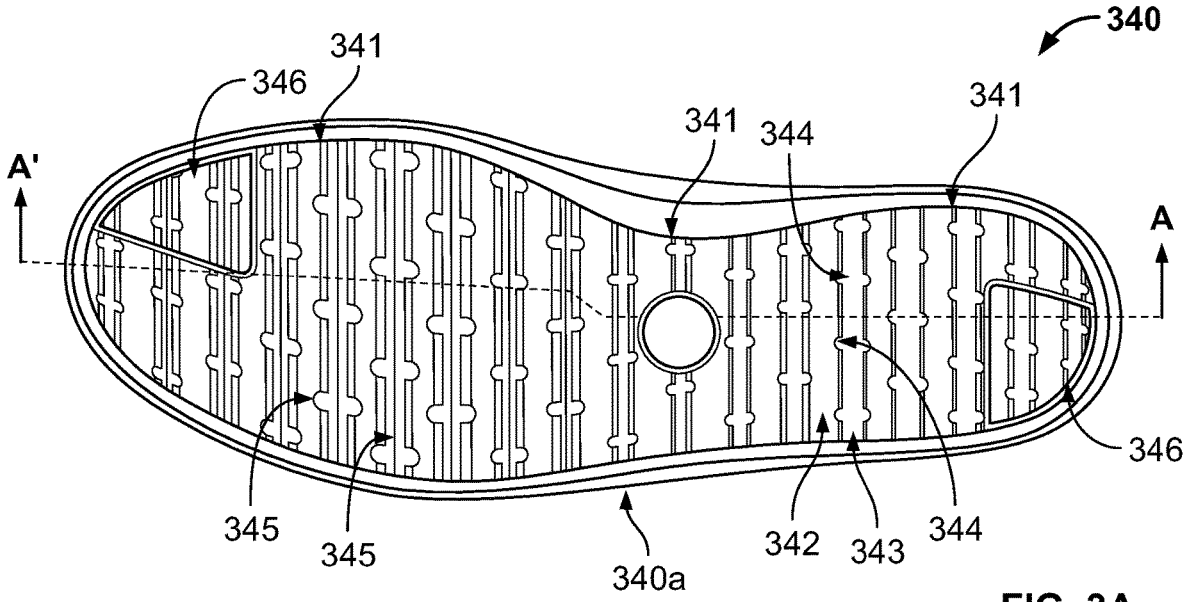
FIG. 3A is a view of the bottom surface of an outsole in accordance with aspects of the technology.
Figure 3B:
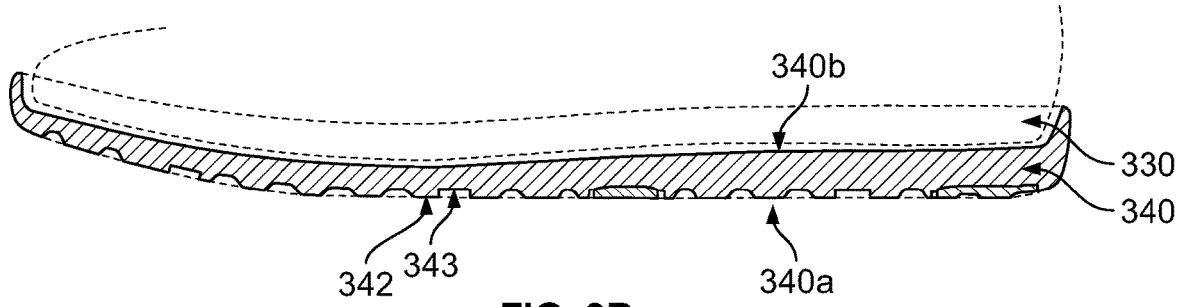
FIG. 3B is a cross-sectional view of an outsole and an insole in accordance with aspects of the technology.
Figure 3C:
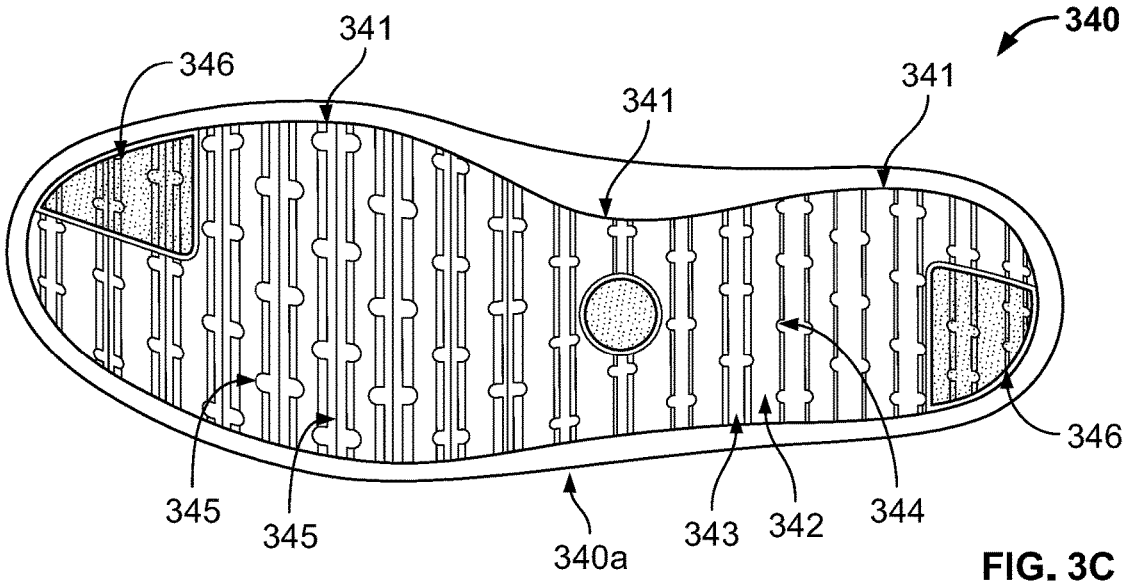
FIG. 3C is a view of the bottom surface of an outsole in accordance with aspects of the technology.

As depicted in FIGS. 3A-C, outsole 340 comprises a bottom surface 340*a* which is configured to contact the ground and a top surface 340*b* which is configured to be permanently secured to the upper and the insole. The bottom surface 340*a* comprises a tread pattern 341 that desirably includes a series of lateral (e.g., transverse) ridges 342 and troughs 343. This series of ridges 342 and troughs 343 may cover approximately 90% or more of the area of the bottom surface 340*a* of the outsole 340, extending from a forefoot portion of the outsole 340 to a heel portion. In one example, each ridge 342 comprises a series of one or more semicircular notches 344 spaced along first and second lateral edges of the ridge. In this case, the notches 344 may be spaced so that the notches 344 on the first edge of a single ridge 342 are offset from the lateral positions of the notches 344 on the second edge of the same ridge. While shown as semicircular, the notches may have different geometric configurations, such as square, triangle, hexagonal, etc.

This tread pattern 341 allows for give or splaying of the outsole 340 when body weight is applied to it during a stride. This is beneficial because the wearer's forefoot may splay upon contact with the ground during a stride in order to naturally absorb shock. While a conventional outsole may seek to "support" the foot by controlling and inhibiting the natural splaying of the forefoot upon impact, the tread pattern of the present outsole is designed to mimic and cooperate with the natural motion of the foot during a stride in order to efficiently and effectively absorb shock and increase stability and comfort.

The outsole 340 of is desirably constructed from materials such as ethylene-vinyl acetate (EVA) and bio-based rubber. These materials may be present in an EVA:rubber weight ratio of at least 80:20, 85:15, 95:5, or, in a preferred embodiment, 90:10.

In one embodiment, the outsole 340 may further comprise a grid of both lateral and/or longitudinal sipes 345, in order to provide for improved flexibility of the shoe. This grid may cover substantially all of the bottom surface of the outsole, or in some embodiments, may only be present in a region extending from a forefoot portion to a midfoot portion of the outsole. The combined lateral and longitudinal siping 345 allows for both improved longitudinal flexibility during a heel to toe stride, as well as for improved lateral flexibility during changes in direction or other side-to-side motions. In particular, the dual direction (e.g., orthogonal) siping 345 works with natural bodily motions. In order to maintain balance and bodily stability, the movement of the ankle joint is naturally used to shift weight to different portions of the foot in order to compensate for changes in position of the upper body while standing stationary or during the walking gait motion. The combined lateral and longitudinal flexibility provided by the siping 345 of the present technology facilitates these natural movements and allows a user to better maintain balance throughout lower and upper body movements.

In some embodiments, the bottom surface 340*a* of the outsole 340 may also include one or more strike pods 346 that function to reinforce the outsole 340 in high-impact, high-friction areas. For instance, one strike pod 346 may be disposed along a heel area of the outsole. This strike pod 346 may be along the medial side, lateral side, or both sides of the heel area. Another strike pod 346 may be disposed along a toe area of the outsole. This strike pod 346 may be along the medial side, lateral side, or both sides of the toe area. The strike pod(s) 346 allow for better "push-off" and heel strike to enhance the foot motion during the walking gait and promote increased durability and longevity of the shoe. These pods are constructed from a material or material composition that is distinct from the rest of the outsole. In some embodiments, the strike pods 346 may be made up of bio-based content and rubber. The bio-based content may comprise a bio-based rubber and a coconut fiber. The bio-based content may be present in a rubber:bio-based content weight ratio of at least 75:25, 80:20, 85:15, and 90:10. In a preferred embodiment, the rubber:bio-based content weight ratio is about 87:13.

Removable Insert

Figure 4A:
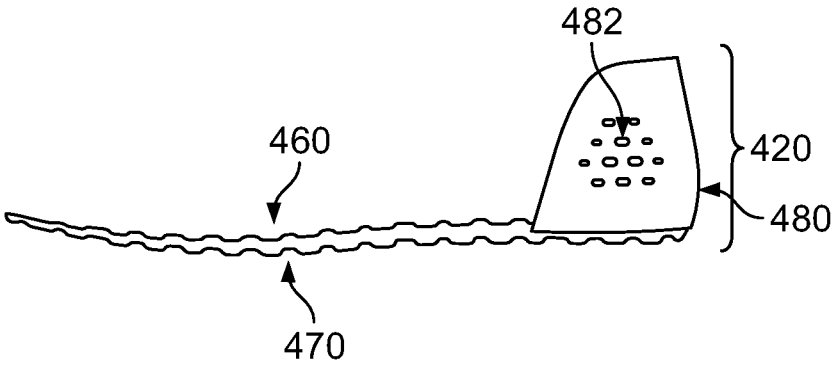
FIGS. 4A and 4B illustrate a removable insert and an exploded view of the removable insert in accordance with aspects of the technology.
Figure 4B:
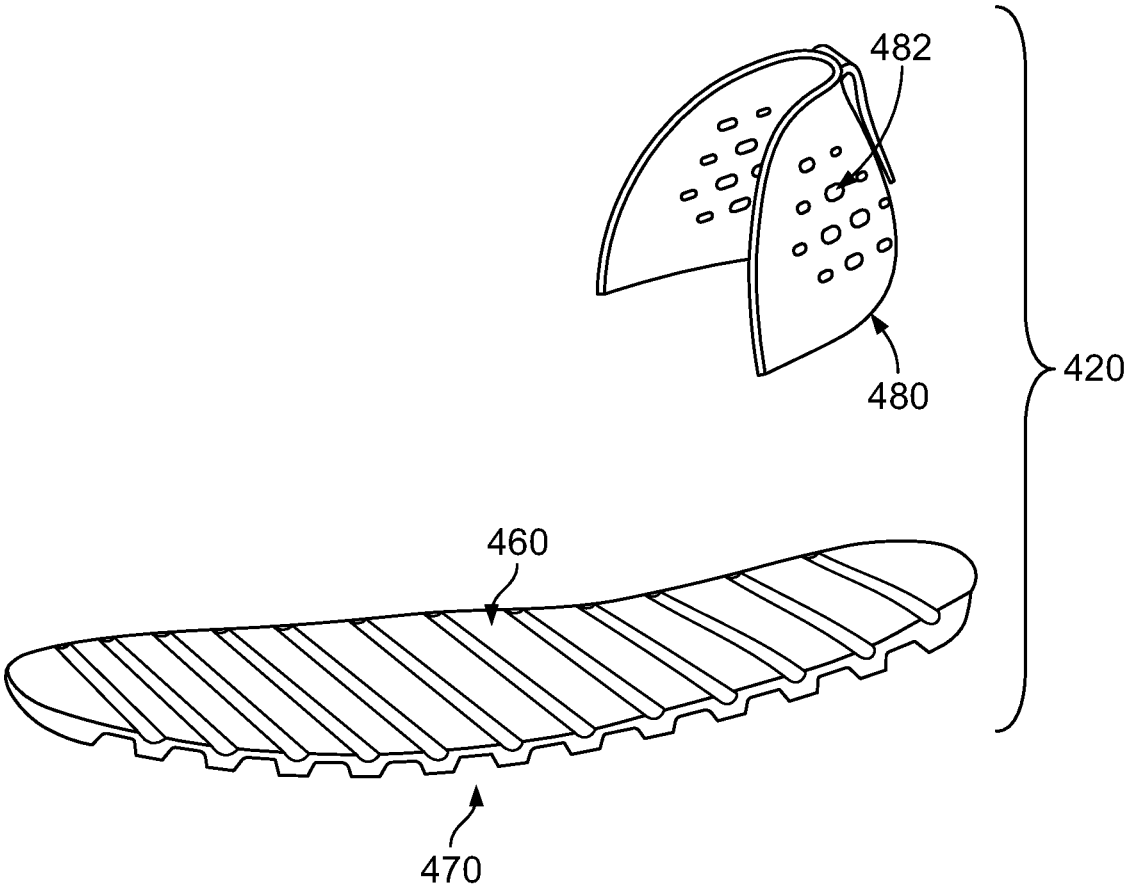

As shown in FIGS. 4A and 4B, in an exemplary embodiment, the removable insert 420 of the present technology comprises three integrated components: a footbed 470, a footbed cover 460, and a heel cup 480. The footbed cover 460 is disposed on top of the footbed 470 and the heel cup 480 extends vertically around a heel portion of the integrated footbed cover 460 and footbed 470. The footbed 470, footbed cover 460, and heel cup 480 are permanently attached to one another, e.g., by stitching, gluing, heat bonding, or the like. The removable insert 420 is designed to fit within a cavity of the shoe defined by the upper and the insole of the shoe during use. However, the removable insert 420 is not permanently attached to the upper or the insole. This configuration allows for the removable insert 420 to be removed and washed, repaired, or replaced in between uses or as needed without damage to the shoe. In some embodiments, this allows for a user to wear the shoe without the use of a sock or other liner, while still maintaining cleanliness and preventing odor in the shoe.

In an alternative embodiment, the removable insert may comprise the footbed 470 and the footbed cover 460. In such an embodiment, the heel cup 480 may be permanently attached to the upper 710 or to the insole 330, or it may be absent altogether. The heel cup, if present, may be removably secured to the footbed 470 and/or to the footbed cover 460. Alternatively, the heel cup may not be secured to the footbed 470 and/or to the footbed cover 460 in any way. The footbed 470 and the footbed cover 460 may be permanently attached to one another, they may be removably secured to one another, or they may not be secured together in any way.

In yet another embodiment, the removable insert may comprise footbed 470, footbed cover 460, and heel cup 480. In such an embodiment, all of the components (i.e., the footbed 470, the footbed cover 460, and the heel cup 480), or selected components (any possible combination of one or more selected from the footbed 470, the footbed cover 460, and the heel cup 480) may be permanently secured to one another, removably attached to one another, or not secured together in any way. Any one, or any combination of one or more, of the components may be permanently or removably secured to the upper 710 or to the insole 330.

Footbed

Figure 5A:
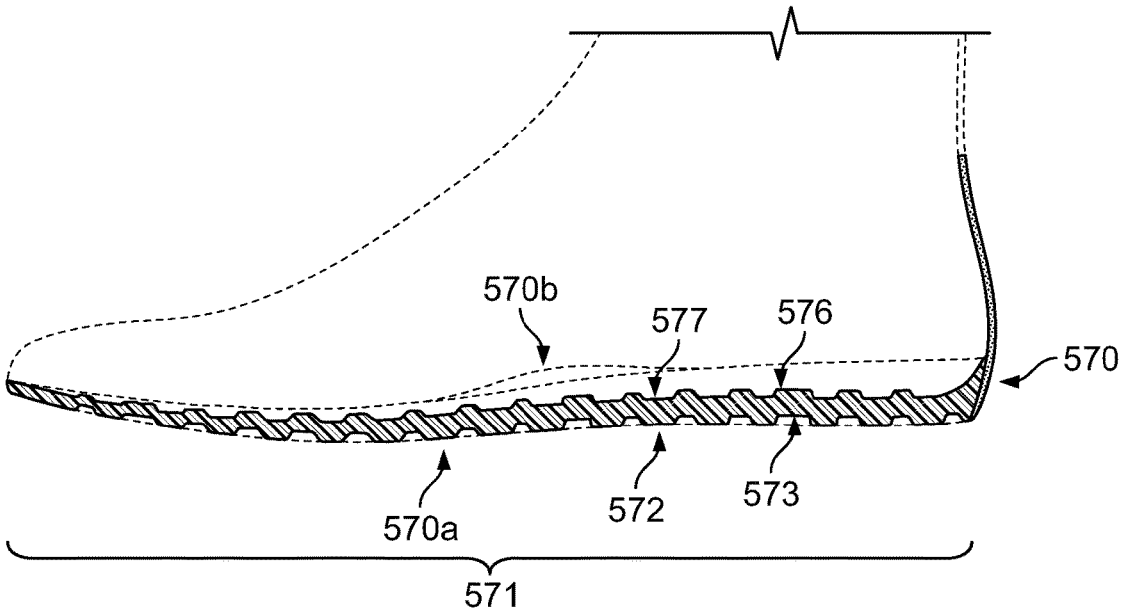
FIG. 5A is a cross-sectional view of an exemplary footbed of the removable insert of FIGS. 4A-B in accordance with aspects of the technology.
Figure 5B:
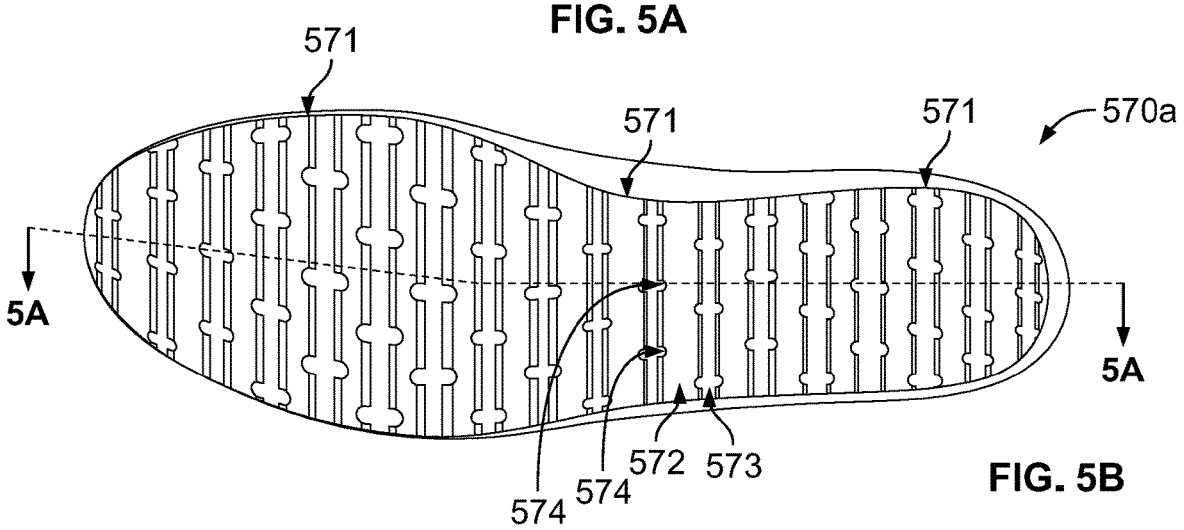
FIG. 5B is a view of the bottom surface of the exemplary footbed of FIG. 5A in accordance with aspects of the technology.
Figure 5C:
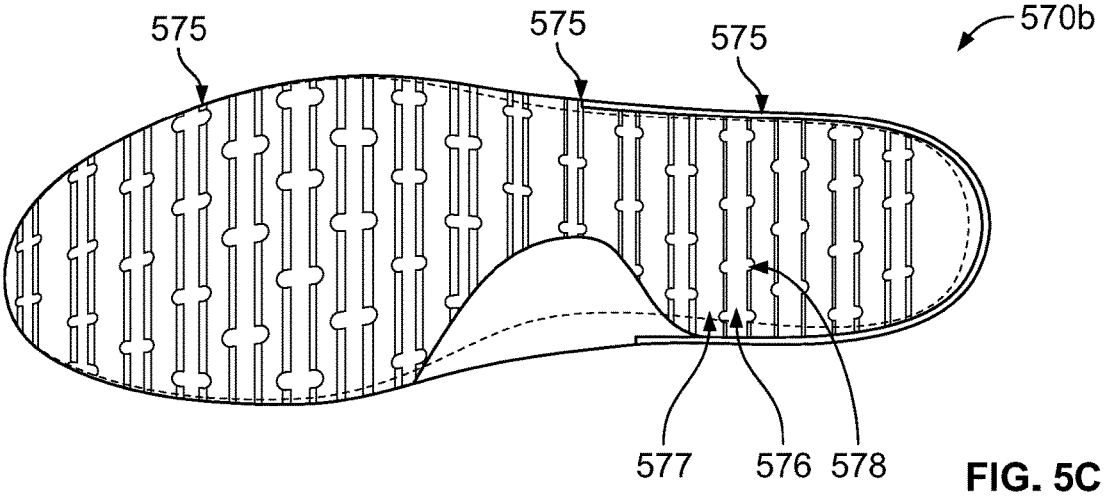
FIG. 5C is a view of the top surface of the exemplary footbed of FIG. 5A in accordance with aspects of the technology.

As shown in an embodiment depicted in FIGS. 5A-C, footbed 570 of the present technology has a bottom surface 570*a*, which is configured to contact the insole of the shoe and a top surface 570*b* which is configured to contact the footbed cover. The bottom surface 570*a* of the footbed 570 includes a tread pattern 571 that corresponds to the tread pattern of the outsole 341, such that these tread patterns 571, 341 are substantially identical. However, as shown in this example, the bottom surface 570*a* of the footbed does not include siping or strike pods. Complementary to the tread pattern 341 of the outsole 340, the tread pattern 571 of the bottom surface of the footbed 570 includes a series of lateral ridges 572 and troughs 573. This series of ridges 572 and troughs 573 covers approximately 90% or more of the area of the bottom surface 570*a* of the outsole 570, extending from a forefoot portion of the outsole 570 to a heel portion. Each ridge 572 may include a series of (semicircular) notches 574 spaced along first and second lateral edges of the ridge. The notches 574 are spaced so that the notches 574 on the first edge of a single ridge are offset from the lateral positions of the notches 574 on the second edge of the same ridge. The notches 574, if employed, may have the same geometric configuration and placement as the notches 344 along the outsole.

This tread pattern 571 allows for give or splaying of the footbed 570 when body weight is applied to it during a stride. This is beneficial because the wearer's forefoot may splay upon contact with the ground during a stride in order to naturally absorb shock. The tread pattern 571 of the footbed 570 is designed to mimic and cooperate with the natural motion of the foot during a stride in order to efficiently and effectively absorb shock and increase stability and comfort.

Each ridge 572, trough 573, and notch 574 of the tread pattern 571 of the bottom surface 570*a* of the footbed 570 desirably corresponds to a matching ridge 342, trough 343, or notch 344 of the tread pattern 341 of the outsole 340. Thus, the bottom surface 570*a* of the footbed 570 and the bottom surface 340*a* of the outsole 340 have common flex points that allow both components to operate in concert to splay when body weight is applied. In this manner, the natural splaying motion is transferred from the foot, to the footbed, and through the outsole to the ground in order to absorb shock and allow normal motion of the foot with respect to the ground.

The top surface 570*b* of the footbed 570 may comprise a tactile pattern 575 which is the inverse of the tread pattern 571 of the bottom surface 570*a*. Thus, in this scenario the lateral ridges 572 of the tread pattern 571 on the bottom surface 570*a* would correspond to lateral troughs 577 of the tactile pattern 575 on the top surface 570*b*. Similarly, the troughs 573 of the tread pattern 571 would correspond to ridges 576 of the tactile pattern 575. Finally, the notches 574 of the tread pattern 571 become knobs or protrusions 578 in the tactile pattern 575. Therefore, the tactile pattern 575 of the top surface 570*b* of the footbed 570 forms a mirror image to the tread pattern 571 of the bottom surface 570*a* of the footbed 570.

This mirror image tactile pattern 575 provides tactile sensation to the sole of the foot during wear. This sensation may allow the wearer to better perceive the motion of the bottom surfaces of the shoe relative to the ground. In addition, the texture and raised portions of the tactile pattern 575 can provide better communication between the foot and the shoe during motion and prevent slipping of the foot inside the shoe.

The footbed 570 of the present technology may be composed of a bio-based foam material. In an exemplary embodiment, this material may be a polyurethane with at least 10%, 15%, 20%, 25%, or most preferably at least 30% by weight bio-based material. The bio-based material of the present technology may be one of a natural oil polyol, or foams, such as polyurethanes and the like, or any mixture thereof. The bio-based foam material of the present technology allows for increased flexibility and lightness of the footbed 570. In a preferred embodiment the bio-based foam material has a density within the range of about 0.32 g/cc to about 0.35 g/cc. Furthermore, the material is safe for both hand and machine washing and remains durable and structurally intact throughout multiple wash cycles.

Footbed Cover

Figure 6B:
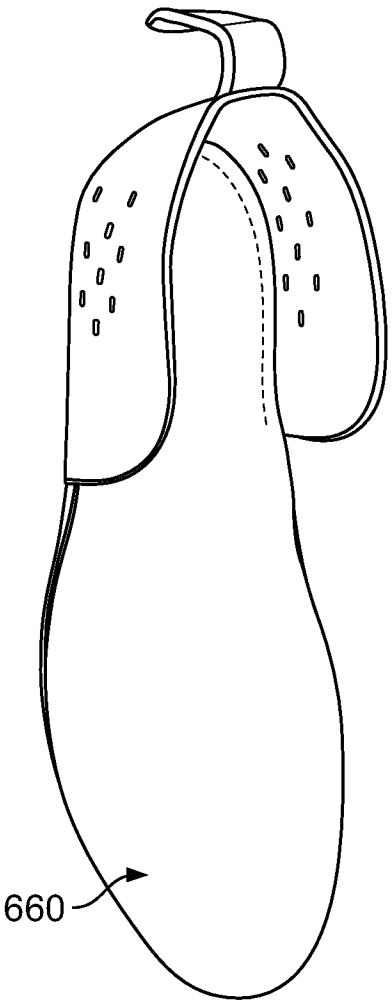
FIGS. 6A and 6B are side and top perspective views of an exemplary footbed cover of the removable insert of FIGS. 4A-B in accordance with aspects of the technology.
Figure 6A:
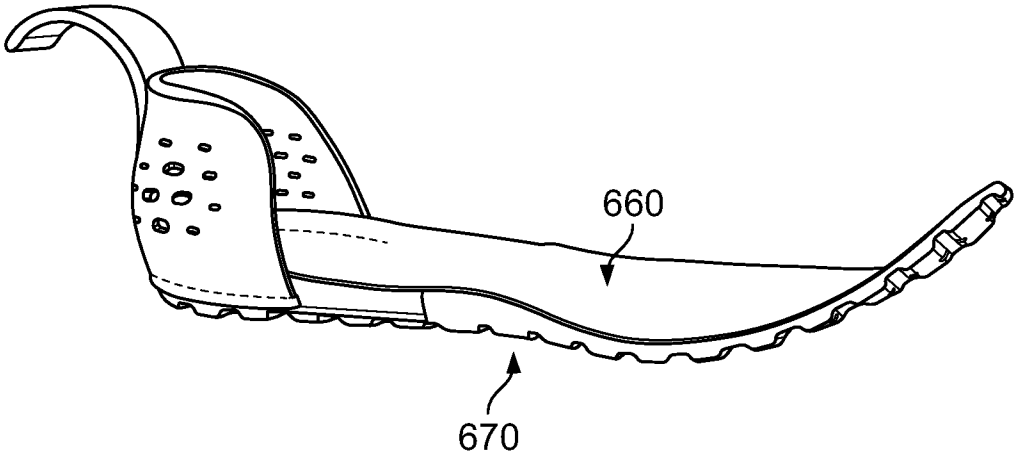

As shown in FIG. 6, in an embodiment, the footbed cover 660 of the present technology may be made of a wool material, for instance merino wool or a wool blend. In some embodiments, footbed cover 660 may comprise merino wool, nylon, recycled polyethylene terephthalate (RPET), cellulosic fibers, or any other suitable natural or bio-based materials. In such an embodiment, the content of merino wool may be within a range of about 30% to about 70% by weight, about 40% to about 60% by weight, or about 45% to about 55% by weight, based on the total weight of the blend. The nylon content may be within a range of about 10% to about 30% by weight, about 15% to about 25% by weight, or about 17.5% to about 22.5% by weight, based on the total weight of the blend. The RPET content may be within a range of about 15% to about 45% by weight, about 20% to about 40% by weight, or about 25% to about 35% by weight, based on the total weight of the blend. In a preferred embodiment, the composition of the blend is about 49% merino wool, about 21% nylon, and about 30% RPET. The material of the footbed cover provides for natural thermoregulation, breathability and wicking of moisture from the foot during use. In addition, the material is chosen to be safe for both hand and machine washing and to remain durable and intact throughout multiple wash cycles.

In an embodiment, the footbed cover 660 is a thin layer that is disposed on top of footbed 670. A thickness of the footbed cover may be between about 0.1 and about 1.5 cm, about 0.1 and about 1.0 cm, or most preferably about 0.3 to about 1.0 cm. The footbed cover 660 is configured to reflect the contours of the tactile pattern of the footbed 670 when permanently affixed to the top surface of the footbed 670. In alternative embodiments, the footbed cover 660 may be removably affixed to the top surface of the footbed 670, or may not be attached to the footbed 670 at all.

Heel Cup

Returning to FIGS. 4A and 4B, the heel cup 480 is a portion of material that, in an embodiment, permanently attaches to both the footbed cover 460 and the footbed 470 along the perimeter of a heel region and extends vertically to wrap around the heel of a user. In alternative embodiments, the heel cup 470 may be removably attached to the footbed cover 460 and/or the footbed 470, or may not be attached to either the footbed cover 460 and/or the footbed 470. The heel cup 480 may include slits or perforations 482 that are configured to promote air flow within an interior portion of the shoe and to allow the foot to breathe.

The heel cup 480 of the present technology may be made up of a merino wool, recycled polyester felt, polyester or nylon blends, or any other suitable natural or bio-based material. Such a material provides for breathability and wicking of moisture from the foot during use. In addition, the material is chosen to be safe for both hand and machine washing and to remain durable and intact throughout multiple wash cycles. The heel cup 480 may be thicker than the thin layer of the footbed cover. For example, the heel cup 480 may have a thickness of between about 0.25 to about 1.5 cm, about 0.5 to about 1.5 cm, or most preferably about 0.5 to about 1.0 cm.

Figure 7A:
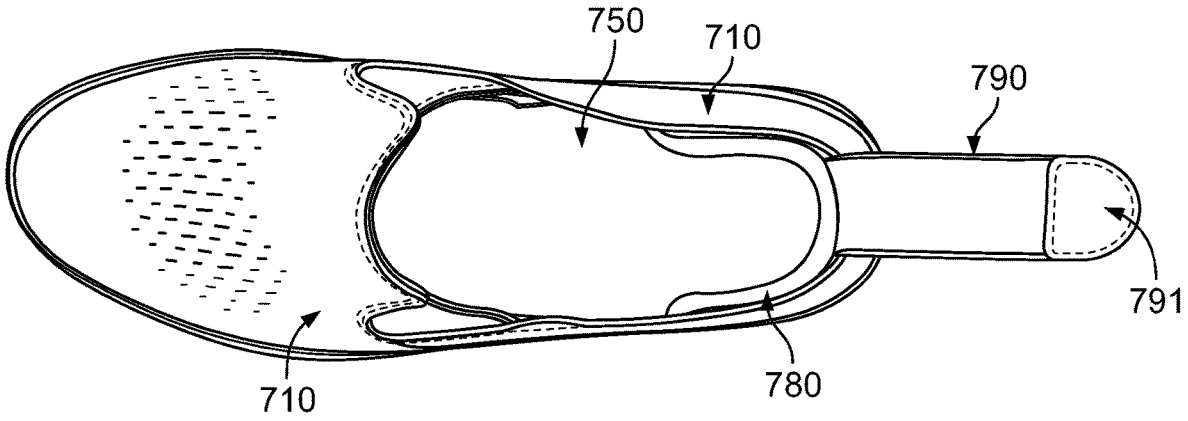
FIG. 7A is a top view of a removable insert and shoe in accordance with aspects of the technology, with an exemplary fastening mechanism in a disengaged position.
Figure 7B:
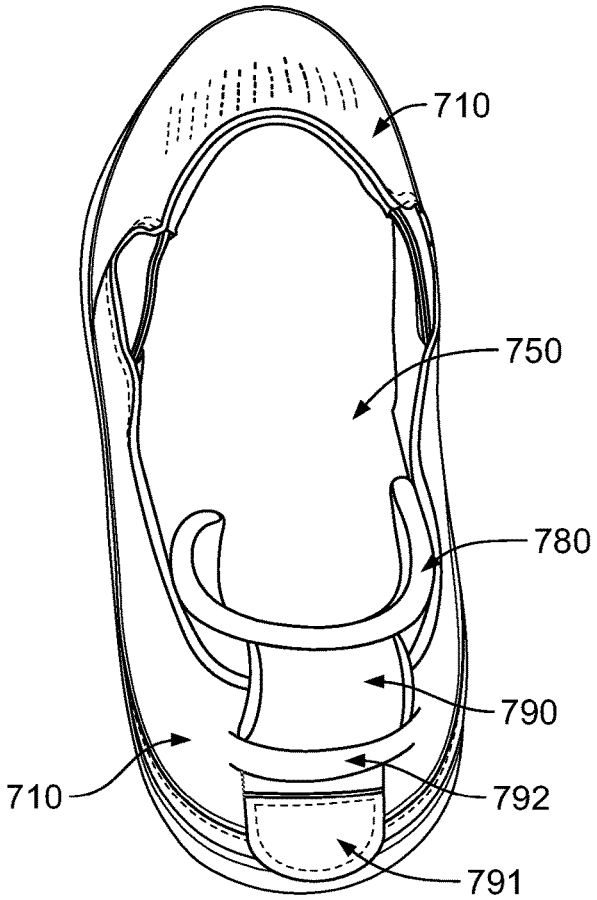
FIG. 7B is a rear perspective view of the removable insert and shoe of FIG. 7A in accordance with aspects of the technology, with the exemplary fastening mechanism in an engaged position.

As shown in FIGS. 7A-7B, in some embodiments, heel cup 780 may further include a fastening mechanism 790, such as a rectangular strap element that extends vertically from the top edge of the heel cup 780 and has a fastener tab 791 disposed on the end furthest from the heel cup 780. In an exemplary embodiment, the fastener tab 791 is a multi-layered section of material which is configured to fit within a fastening dock 792 provided on the upper 710, as shown in FIGS. 7A-B. In this case, one or more additional layers of material are provided on the end of the rectangular strap. These one or more additional layers of material are configured to thicken a portion of the rectangular strap element designed to be received in the dock 792 provided in the upper 710 so that increased friction prevents the multilayered portion from disengaging with the slot 792. The strap element is configured to wrap over the top edge of the upper along the heel so that the fastener tab 791 engages with a fastening dock 792 or other complementary receptacle element to secure the heel cup 780 to the upper 710, when the heel cup 780 is disposed within cavity 750 of the shoe. In an exemplary embodiment, the fastening dock 792 is a slot provided on the upper 710 which is configured to receive the fastener tab 791. However, the form of the fastening dock 792 is not particularly limited and may be any element complementary to the fastener tab 791 of the heel cup.

In alternative embodiments, other suitable fastening mechanisms 790 may be employed, including a button or buttonhole, a section of hook and loop fastener, a snap, a section of ferromagnetic metal, or an alternative configuration of the tab and dock mechanism described above. The fastening mechanisms described in this section may be employed to removably attach the footbed, the footbed cover, the heel cup, or any combination therein, to the upper and/or to the insole and/or to one another, in any suitable configuration. For example, in an embodiment, a fastening mechanism 790 may be used to removably attach the heel cup to the footbed and/or to the footbed cover. In some embodiments, a fastening mechanism 790 may be employed to attach the footbed, the footbed cover, and/or the heel cup to the upper or to the insole within the cavity of the shoe, such that no part of the fastening mechanism extends outside of the cavity of the shoe.

Removable Insert

As noted above, in one example, the removable insert comprises the footbed, the footbed cover, and the heel cup, all permanently affixed to one another. The footbed cover may be adhered to the top surface of the footbed using any adhesive suitable for such purpose, such as solvent-based polyurethane adhesives and the like. Alternatively or in combination with adhesion, the footbed cover may be stitched to the footbed. The thin footbed cover may be closely adhered to the footbed so that the footbed cover reflects the contours of the tactile pattern of the footbed such that they may be felt on the sole of the foot of a user wearing the shoe. The heel cup is then permanently secured to both the footbed cover and the footbed by, e.g., stitching and/or gluing along the perimeter of a heel portion of the integrated footbed cover and footbed. In an alternative embodiment, the footbed cover may be removably attached to the footbed, or may not be attached to the footbed at all.

Insole

As shown an embodiment depicted in the cross-sectional view of FIG. 3B, the insole 330 is a generally flat member with a bottom surface that is configured to contact the top surface 340*b* of the outsole 340 and a top surface which is configured to contact the upper along a perimeter region. The insole 330 is may comprise cellulose, polyester, nylon, polypropylene or any mixtures thereof. The bottom surface of the insole 330 is permanently attached to the outsole 340 using stitching and/or any adhesive suitable for such purpose, such as aqueous or solvent-based adhesives. The top surface contacts and is stitched, glued or otherwise permanently secured to the upper in a perimeter region. Thus, the insole 330 is permanently attached to both the outsole 340 and the upper. As noted above, the top surface of the insole, which receives the bottom surface of the footbed, does not include a tread pattern such as is provided on the bottom surfaces of the outsole and footbed. In contrast, the top surface of the insole 330 is generally smooth.

Upper

As shown in FIGS. 2A-B, the upper 210 is permanently secured to the top surfaces of both the outsole 240 and the insole 230 long their perimeters and extends upwards to form the cavity 250 configured to receive both the removable insert 220 and the foot of a wearer. In all embodiments, the upper 210 is desirably constructed of as few sections of material as possible in order to avoid material waste, to decrease manufacturing costs, and to maintain a clean and stylish aesthetic.

As shown in shoe examples 800 and 800' of FIGS. 8A and 8B, respectively, in some embodiments, the upper may be made up of a natural leather material. In such an embodiment, the upper may include a pattern of knife-cuts, slits, circular, oval, diamond, or triangular shaped holes, or other perforations 811 along a forefoot section thereof. These perforations are configured to expand when force is applied. For example, the perforations 811 may allow the leather to flex and stretch when pressure is applied to the upper as a result of either the size of the user's foot or motion of the foot during wear. Thus, the perforations 811 allow for greater comfort and mobility and also promote ventilation and thermoregulation within the shoe.

In some embodiments, for instance as shown in FIG. 8A, the perforations 811 may be present in the center of a forefoot region of the upper 810. In other embodiments, for instance as shown in FIG. 8B, the perforations 811 may be present only along the edges of the forefoot region of the shoe 800. The perforations 811 may be relatively the same size and shape. Or, alternatively, the perforations 811 may differ in size and shape. In particular, a pattern of perforations may have perforations of larger length, width, or diameter in the center of the pattern, with smaller perforations disposed along the outer edges of the pattern. In some embodiments of the present technology, the perforations 811 may be aligned with one another, while in other embodiments, they may be offset from one another, or randomly spaced.

Figure 9:
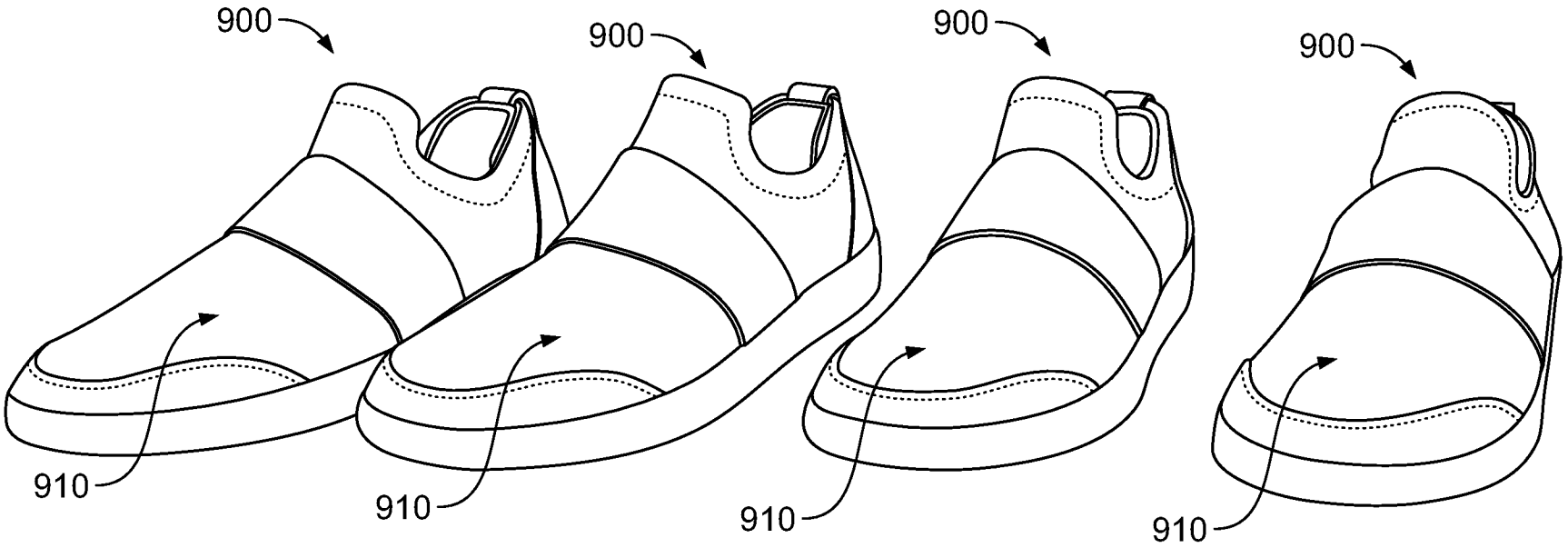
FIG. 9 is a depiction of exemplary uppers in accordance with aspects of the technology.

As shown in the shoes 900 of FIG. 9, in other embodiments, the upper 910 may be made up of a fabric or knit material. In this case, there may be no perforations along the forefoot section of the upper. In some embodiments, the fabric or knit material may be made up of a 100% recycled polymer blend. In alternative embodiments, the fabric or knit material may comprise natural fibers, polyesters, nylons, or any mixtures thereof. The fabric or knit material may be configured to be elastic such that it stretches around a user's foot in order to provide increased mobility and range of motion of the foot. The elasticity of the material may also allow the shoe to adequately grip the foot without the need for a lacing component.

Figure 10:
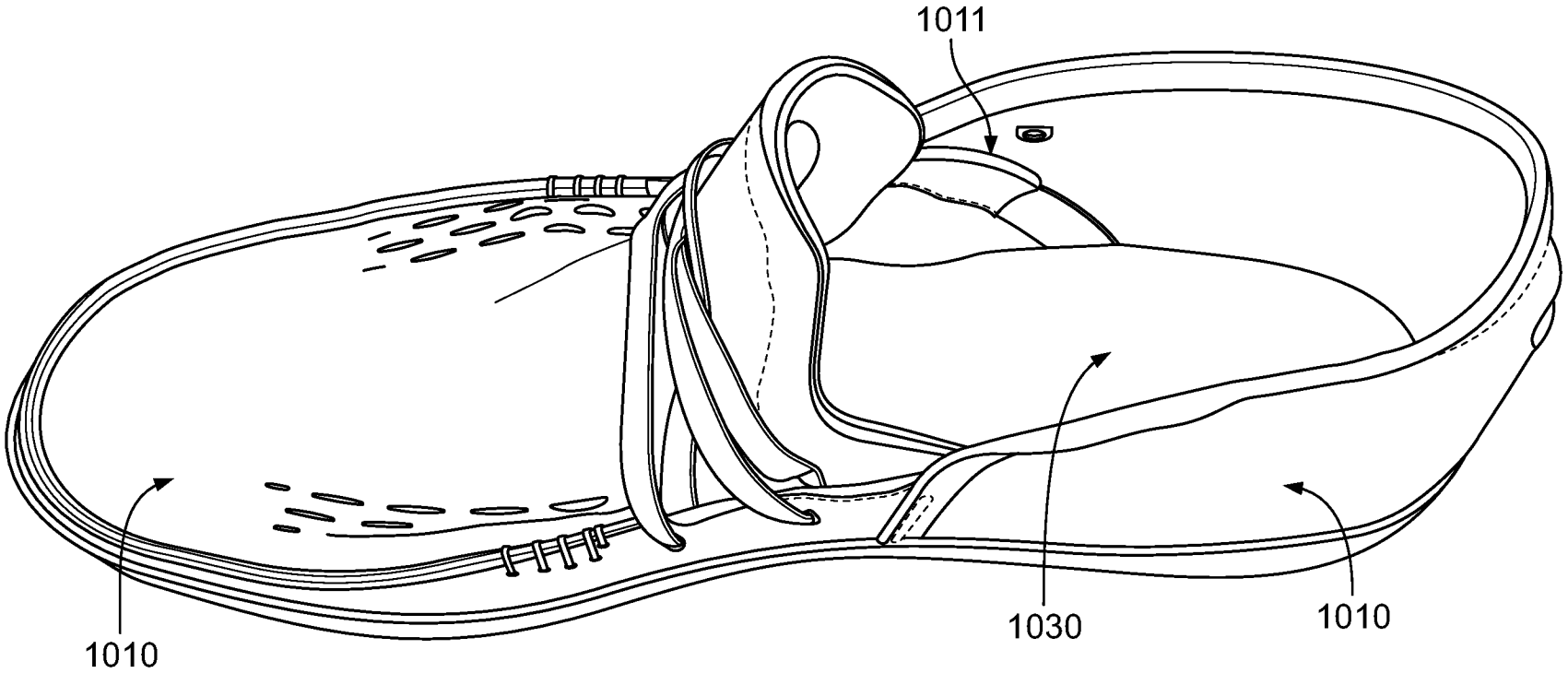
FIG. 10 is a depiction of an exemplary shoe having elastic straps in accordance with aspects of the technology.

In some embodiments, a forefoot portion of the upper may be secured to the insole by elastic straps. As shown in FIG. 10, portions of the forefoot section of the upper 1010 may extend past and within a heel section of the upper on symmetrical lateral sides of the shoe. This forefoot portion of the upper may be secured to the insole of the shoe by elastic straps 1011 or other elastomeric elements that are stitched or otherwise permanently secured to the forefoot portion of the upper 1010 on one end and to the insole 1030 on the other end. In this way, the elastic may stretch to allow the forefoot of the upper 1010 to expand, e.g., in order for a wearer to fit their foot into the shoe. Once the wearer's foot is settled within the shoe, the elastic may contract, allowing the forefoot section of the upper 1010 to fit snugly against the wearer's foot.

Lacing Component

Figure 11:
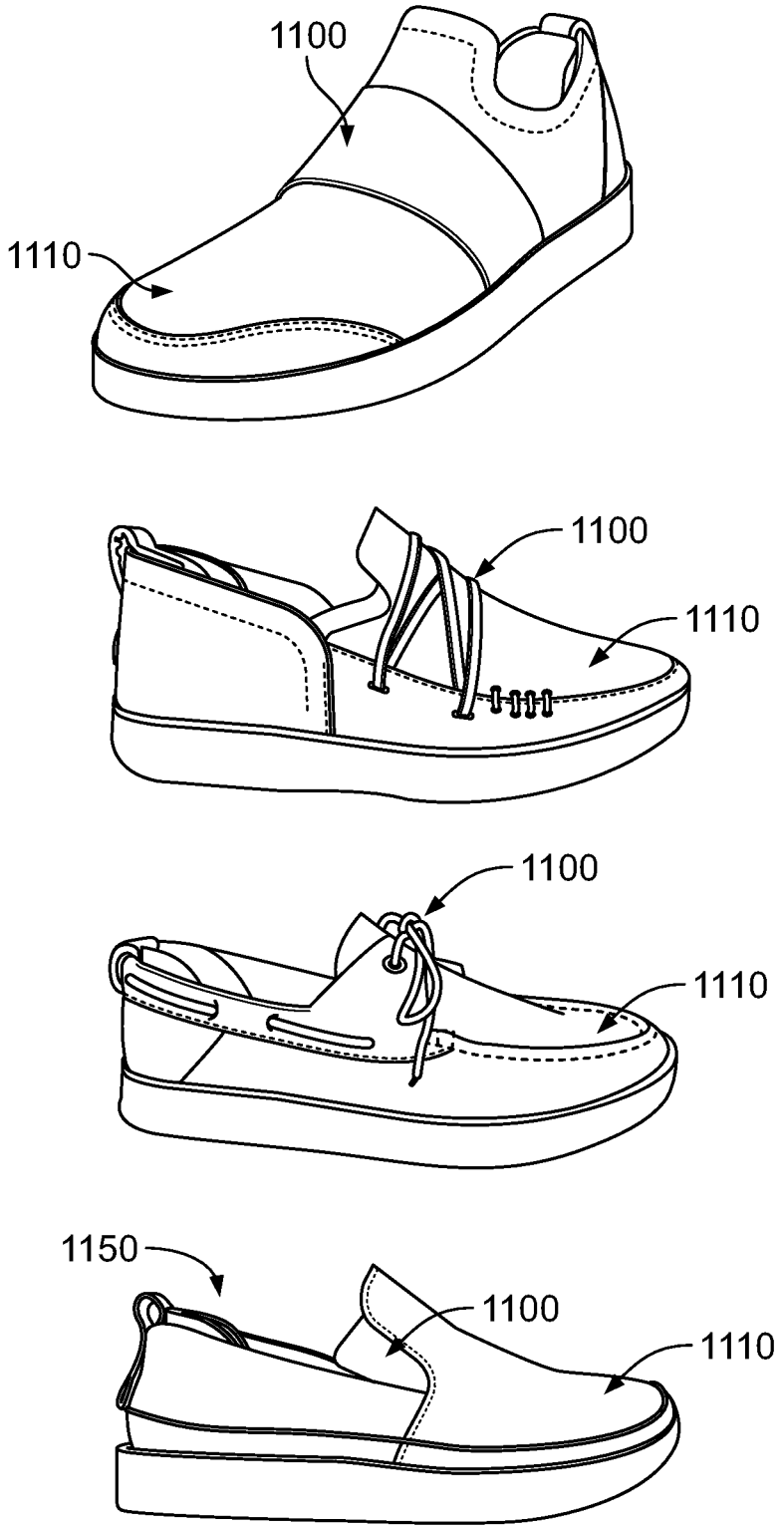
FIG. 11 is a depiction of various different lacing components that may be employed in accordance with aspects of the technology.

As shown in FIG. 11, some embodiments do include a lacing component 1100 designed to secure the upper 1110 snugly around the foot while in use. The lacing component 1100 may be a series of crisscrossing elastic straps that extend across a midfoot portion of the upper 1110 and are secured by passing through slots located on the lateral edges of the upper.

Alternatively, in some embodiments, the lacing component 1100 may be a cord made of natural fiber such as organic cotton, hemp, and/or flax. In other embodiments, the cord may comprise synthetic materials such as polyester or nylon blends. In some embodiments, this cord may extend across only a midfoot portion of the shoe, while in other embodiments, it may further extend around a heel portion of the upper 1010. The cord may be secured to the upper in a variety of ways, including through the use of slots, holes, or brackets disposed along the sides or edges of the upper.

In other embodiments, the lacing component 1100 may be in the form of elastic inserts placed in cut-outs in sections of the upper. Some embodiments may include two matching cut-outs placed on opposite sides of the upper 1110, near the edge of the cavity 1150 configured to receive a foot. These cut-outs may then be filled with an elastic material stitched to the upper 1110 along the edges. These elastic inserts may allow the upper 1110 to stretch and the cavity 1150 to expand in order to fit a foot securely into the shoe. In other embodiments, a large rectangular elastic insert may be used, such that it extends across a midfoot portion of the upper from one lateral edge to the other.

Mechanical Operation of the Shoe

As explained above, footwear in accordance with aspects of the technology comprise an outsole, an insole, and an upper, that are permanently attached to one another. The insole is adhered to the top surface of the outsole and the upper is permanently affixed to both the outsole and the upper along their perimeter regions, so that a cavity is formed between the insole and the upper. This cavity is configured to receive the removable insert of the present technology.

The removable insert fits within the cavity so that the bottom surface of the footbed contacts the flat or substantially planar top surface of the insole. The heel cup fits snugly within a heel portion of the upper and may include a fastening mechanism that extends vertically and wraps around the edge of the upper so that a fastener on one end of the fastening mechanism can engage with a complementary fastening dock disposed on upper. In this way, the removable insert may be removably secured within the shoe. When the removable insert is secured within the shoe, the receptacle formed between the upper and the footbed cover of the removable insert is configured to receive a wearer's foot.

Accordingly, the footbed is disposed on top of the insole, which is disposed on top of the outsole. While the insole is permanently affixed to the outsole, the footbed is not permanently affixed to either the insole or the outsole. The bottom surfaces of both the outsole and the footbed each have an equivalent tread pattern comprising a series of ridges and troughs. Such tread patterns may be substantially identical in both elements. Thus, each ridge of the tread pattern of the footbed aligns with a matching ridge of the tread pattern of the outsole and each trough of the tread pattern of the footbed aligns with a matching trough of the tread pattern of the outsole. By contrast, the insole is substantially planar or otherwise generally smooth, for instance without any grooves, recesses, slits, holes, divots, ridges, troughs, or the like.

During use, as a user transfers weight from heel to toe during a stride, the tread pattern of the footbed allows the integrated footbed cover and footbed of the removable insert to splay in concert with the natural motion of the foot in order to absorb the shock of contact with the ground. The corresponding ridge and trough pattern of the outsole allows the outsole to move in cooperation with the insert in order to allow the natural motion of the foot to be translated through the layers of the shoe to the outsole and eventually to the ground in order to mimic a more natural barefoot stride. The inverse tactile pattern on the top surface of the footbed cover allows the motion of the layers of the shoe and the contours of the ground to be translated back to and perceived by the user via tactile input against the sole of the bare foot. This allows the user to better respond and react to the terrain and conditions underfoot. The texture of the tactile pattern of the footbed cover additionally provides for increased friction against a user's foot and prevents slipping of the foot within the shoe. In addition, the slits and perforations in the outsole of the shoe allow for stretching and expansion as weight is transferred from heel to toe or from side to side in order to avoid impeding normal range of motion during walking, running, or balancing maneuvers.

The invention claimed is:

1. A shoe, comprising:

an upper;

an insole having a substantially planar top surface and a bottom surface opposite the top surface;

a space between the upper and the insole defining a cavity adapted to receive a wearer's foot;

an outsole having a bottom surface configured to contact the ground and a top surface opposite the bottom surface, the top surface of the outsole being permanently secured to the bottom surface of the insole and to a perimeter of the upper, and the bottom surface of the outsole having a tread pattern comprising a series of lateral ridges and troughs; and a removable insert having a bottom surface configured to contact the substantially planar top surface of the insole and a top surface opposite the bottom surface and configured to contact a wearer's foot during wear, the bottom surface of the removable insert having a tread pattern that corresponds to the tread pattern of the outsole;

wherein the removable insert is received within the cavity defined by the upper and the substantially planar top surface of the insole.

2. The shoe of claim 1, wherein:

the removable insert comprises an footbed cover having a top surface and a bottom surface, and a footbed having a top surface and a bottom surface; and the bottom surface of the footbed comprises the tread pattern of the removable insert.

3. The shoe of claim 2, wherein the bottom surface of the footbed cover is permanently affixed to the top surface of the footbed, and a heel cup is attached to both the footbed cover and the footbed in a heel region thereof.

4. The shoe of claim 2, wherein the footbed has a tactile pattern on the top surface thereof, the tactile pattern having contours in an inverse of the tread pattern on the bottom surface of the footbed.

5. The shoe of claim 2, wherein the footbed comprises a bio-based foam.

6. The shoe of claim 2, wherein the top surface of the footbed cover reflects the contours of the tactile pattern of the footbed.

7. The shoe of claim 2, wherein the footbed cover comprises at least one selected from the group consisting of merino wool, nylon, recycled polyethylene terephthalate (RPET), and cellulosic fibers.

8. The shoe of claim 1, wherein the removable insert includes a fastening tab and the upper includes a fastening dock configured to receive and engage the fastening tab to removably secure the removable insert to the upper.

9. The shoe of claim 8, wherein the fastening tab and the fastening dock form corresponding parts of a fastening mechanism selected from the group consisting of a tab and slot, hook and loop fasteners, a snap connection, a button and slot, and complementary ferromagnetic materials.

10. The shoe of claim 1, wherein the tread pattern of the outsole and the corresponding tread pattern of the removable insert are configured to allow the removable insert and the outsole to move in a same manner during wear by a wearer.

11. The shoe of claim 10, wherein the removable insert and the outsole are both configured to splay in response to application of pressure during a stride in accordance with the respective tread patterns.

12. The shoe of claim 1, wherein the outsole further includes a grid pattern of both longitudinal and lateral sipes.

13. The shoe of claim 1, wherein:

the tread pattern of the outsole is formed with a first material, the outsole further includes one or more strike pods formed along the bottom surface, and the strike pods are formed of a second material different from the first material.

14. The shoe of claim 1, wherein the upper includes a pattern of perforations in a forefoot region thereof, the perforations providing ventilation and flexibility, and the perforations being configured to expand when force is applied to the interior of the upper.

15. The shoe of claim 14, wherein the perforations are one or more of circles, ovals, slits, triangles or diamonds.

16. The shoe of claim 14, wherein the pattern includes perforations of a larger dimension in a center region of the pattern and perforations of a smaller dimension along a perimeter region of the pattern.

17. The shoe of claim 1, wherein a forefoot region of the upper is at least partly secured to the top surface of the insole by elastic straps disposed with the cavity of the shoe.

* * * * *